US005400385A

United States Patent [19]

Blake et al.

[11] Patent Number: 5,400,385

[45] Date of Patent: Mar. 21, 1995

[54] HIGH VOLTAGE POWER SUPPLY FOR AN X-RAY TUBE

[75] Inventors: James A. Blake, Franklin; Jonathan R. Schmidt, Wales; Michael A. Wu, Waukesha, all of Wis.

[73] Assignee: General Electric Company, Milwaukee, Wis.

[21] Appl. No.: 116,143

[22] Filed: Sep. 2, 1993

[51] Int. Cl.[6] ..... H05G 1/34

[52] U.S. Cl. ..... 378/110; 378/101; 378/112; 363/97; 323/280

[58] Field of Search ..... 378/101, 107, 108, 109, 378/110, 111, 112; 363/79, 78, 88, 96, 97, 98, 41, 95; 323/280

[56] References Cited

U.S. PATENT DOCUMENTS

| | | | |
|---|---|---|---|
| 4,460,949 | 7/1984 | Steigerwald | 363/28 |
| 4,477,868 | 10/1984 | Steigerwald | 363/28 |
| 4,504,895 | 3/1985 | Steigerwald | 363/17 |
| 4,541,041 | 9/1985 | Park et al. | 363/41 |
| 4,703,496 | 10/1987 | Meccariello et al. | 378/112 |
| 5,001,735 | 3/1991 | Sammon | 378/110 |

*Primary Examiner*—David P. Porta

*Assistant Examiner*—Don Wong

*Attorney, Agent, or Firm*—Quarles & Brady

[57] ABSTRACT

A supply for a high bias voltage in an X-ray imaging system has an inverter and a voltage multiplier that produce an alternating output voltage in response to control signals. A voltage sensor produces a signal indicating a magnitude of the output voltage. A circuit determines a difference between the sensor signal and a reference signal that specifies a desired magnitude for the output voltage and that difference is integrated to produce an error signal. The error signal preferably is summed with a precondition signal that is an approximation of a nominal value for the signal sum and the summation producing a resultant signal. Another summation device arithmetically combines the resultant signal and the sensor signal with a signal corresponding to a one-hundred percent duty cycle of the inverter operation in order to produce a duty cycle command. An inverter driver generates the inverter control signals that have frequencies defined by the resultant signal and have duty cycles defined by the duty cycle command. A unique state machine is described which generates those control signals.

15 Claims, 5 Drawing Sheets

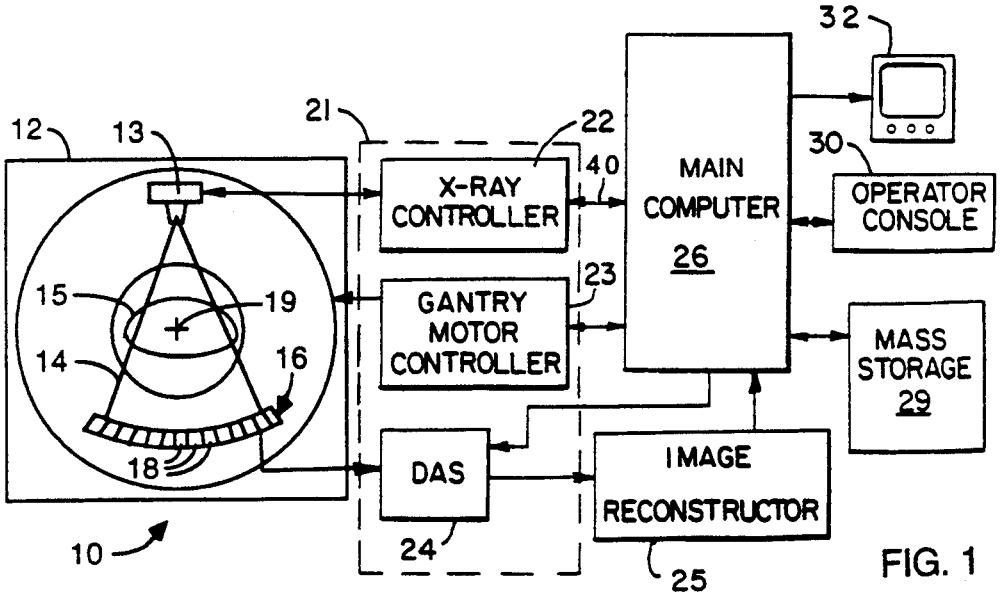
FIG. 1
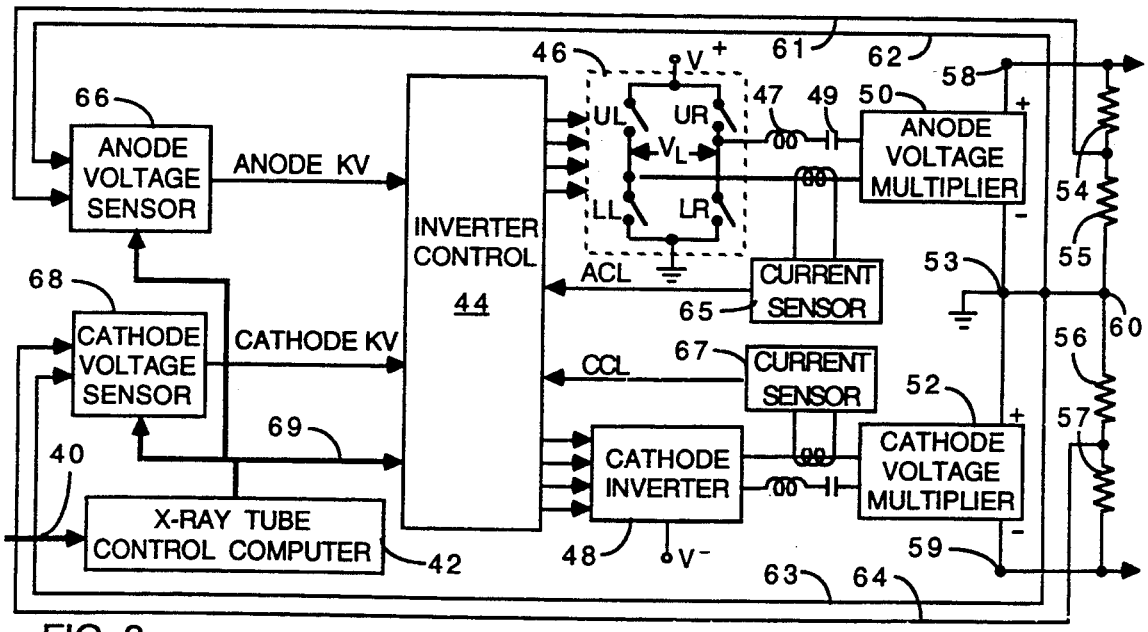
FIG. 2
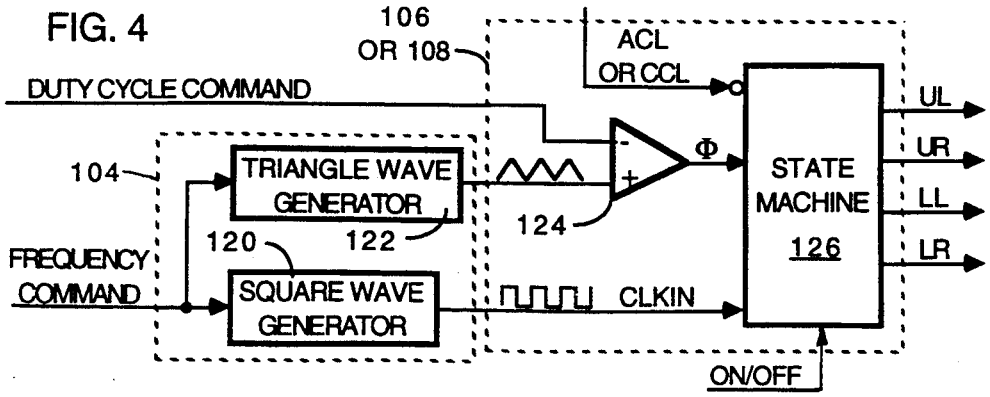

INVERTER CONTROL 44

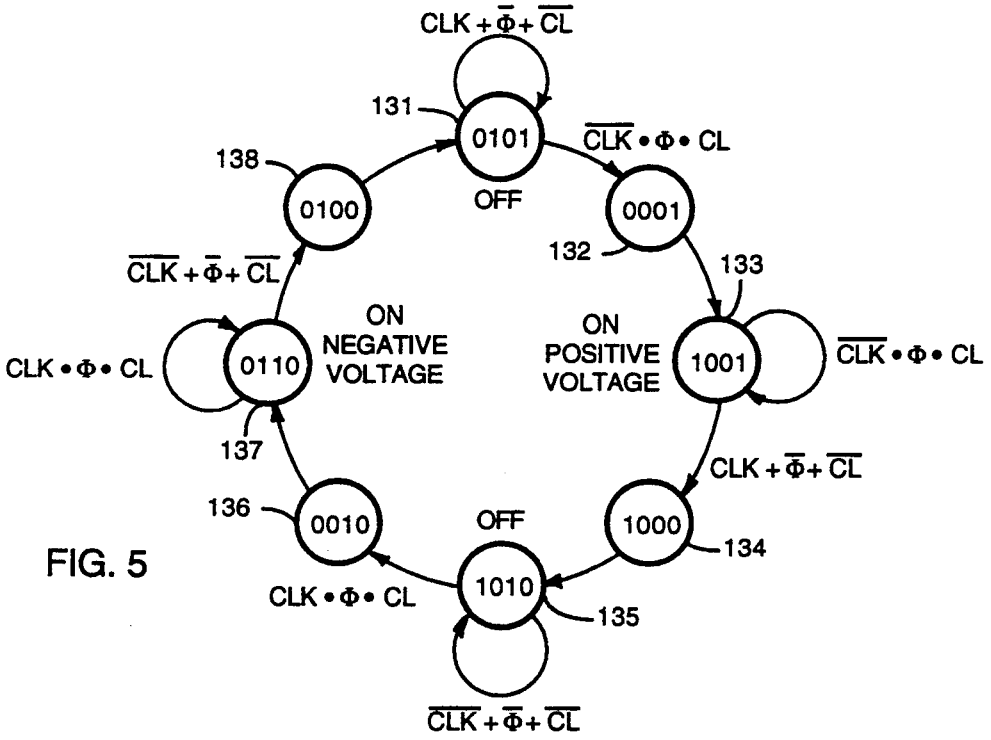
FIG. 5
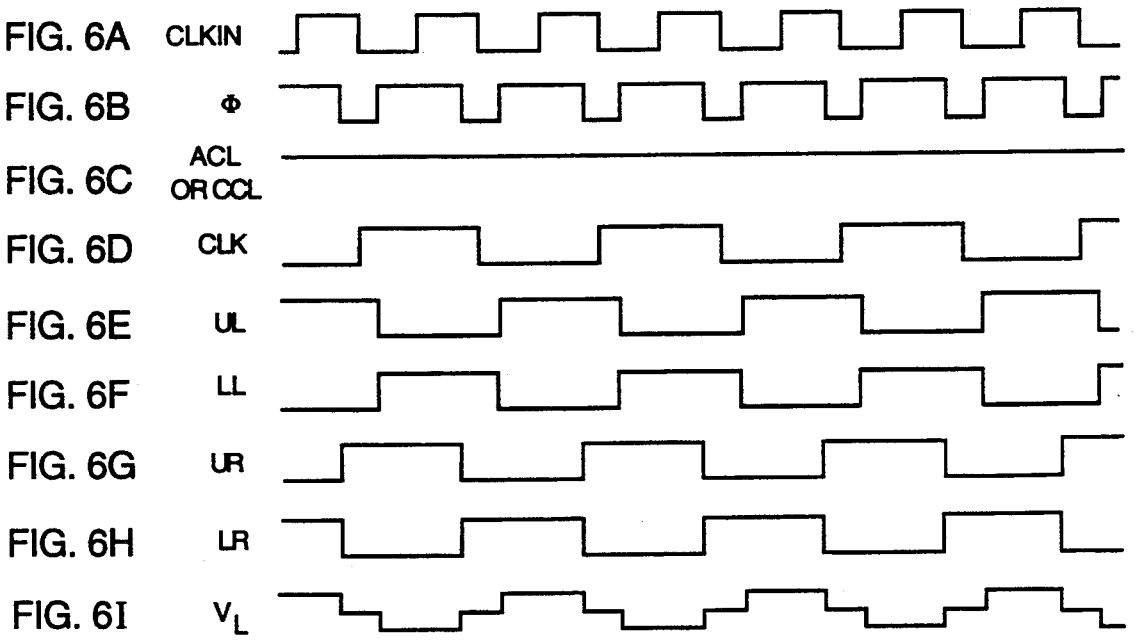

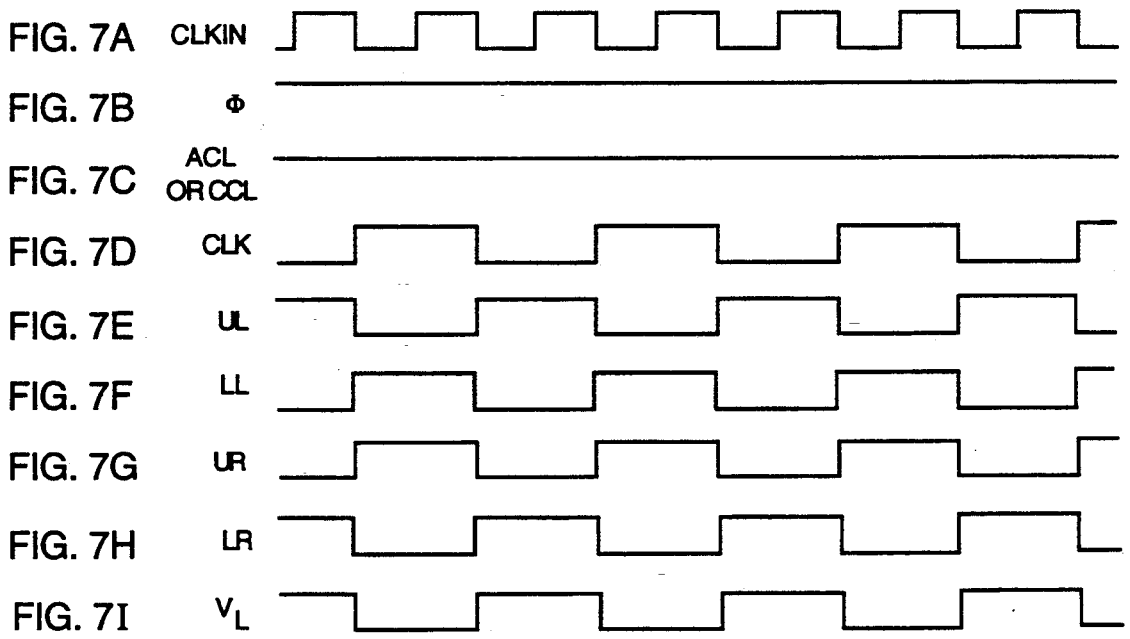
FIG. 7A
CLKIN
FIG. 7B
Φ
FIG. 7C
ACL OR CCL
FIG. 7D
CLK
FIG. 7E
UL
FIG. 7F
LL
FIG. 7G
UR
FIG. 7H
LR
FIG. 7I
$V_L$
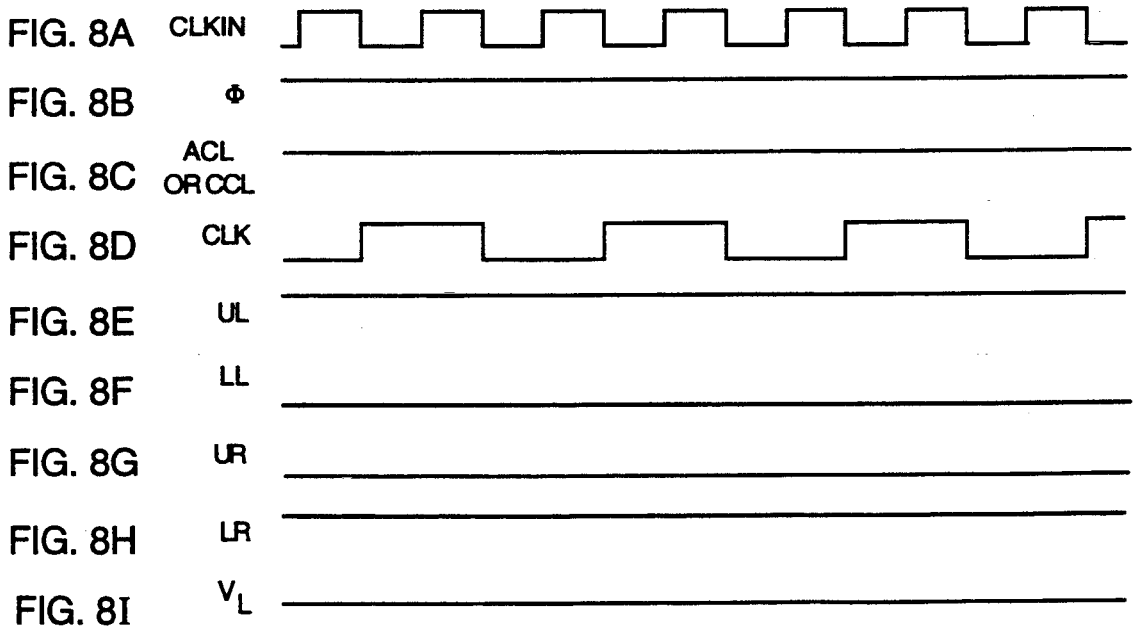
FIG. 8A
CLKIN
FIG. 8B
Φ
FIG. 8C
ACL OR CCL
FIG. 8D
CLK
FIG. 8E
UL
FIG. 8F
LL
FIG. 8G
UR
FIG. 8H
LR
FIG. 8I
$V_L$

CLKIN

Φ

ACL
OR CCL

CLK

UL

LL

UR

LR $V_L$

HIGH VOLTAGE POWER SUPPLY FOR AN X-RAY TUBE

BACKGROUND OF THE INVENTION

The present invention relates to high voltage power supplies used in X-ray imaging equipment, and more particularly to circuitry for controlling an inverter used in such power supplies.

During an X-ray exposure, the high voltage across the anode and cathode of the X-ray tube must be carefully regulated. Such regulation not only is required to insure that a proper X-ray exposure occurs, but also to insure that an excessively high and harmful dose of X-rays is not produced. Typically, the regulation is performed by sensing the output of the high voltage supply for the X-ray tube. The sensed voltage is compared to the desired voltage for the selected exposure parameters. The result of that comparison is used to control the production of the high anode-cathode voltage that excites the X-ray tube.

The high voltage power supply can utilize a series resonant inverter circuit, a common type of which is referred to as an "H bridge." The load for the inverter is connected in the horizontal branch of the H bridge in series with inductance and capacitance, and each of the four vertical branches of the H has an electrically operated switch. A high DC voltage is applied across the branch ends at the top and bottom of the H. An alternating voltage can be applied across the load, by rapidly alternating the state of the diagonally opposed pairs of electrical switches. The alternating voltage produced by the inverter is coupled to a voltage multiplier, which increases the voltage to a level necessary for proper excitation of the X-ray tube and production of X-rays.

The inverter is operated by a control circuit, which receives a command reference signal indicating the level of high voltage required for the exposure selected by the operator. In addition, the control circuit receives a measurement of the output voltage produced by the voltage multiplier. This information is used by the control circuit to produce a particular drive frequency for the switch elements of the inverter.

A common high voltage supply for an X-ray tube utilizes a separate inverter and voltage multiplier for the cathode and the anode bias potentials with the output of the two voltage multipliers connected in series with a ground node in between. The anode inverter often is adjusted so that the anode voltage multiplier produces a higher output voltage than the cathode inverter and voltage multiplier combination for a given inverter drive frequency. In this arrangement, the output of the anode voltage multiplier is compared to the command reference signal to derive an error signal that forces adjustment of the anode inverter's duty cycle to reduce the output voltage from the anode voltage multiplier to achieve the desired voltage level for exciting the X-ray tube. However, this method presents a problem during recovery from a high voltage breakdown of the X-ray tube, commonly referred to as a "spit." The response time is necessarily quite slow since it is governed by the band pass feedback loop stability constraints. The slower the recovery time results in loss of X-ray data or in the case of a computed tomography system, loss of views.

This control method also requires careful adjustment of the inverter resonant frequency for both the anode and the cathode. A loss of control can result if the adjustment is made incorrectly.

SUMMARY OF THE INVENTION

A high voltage power supply for an X-ray tube has a source of a reference voltage that specifies a desired bias voltage magnitude for the X-ray tube. An inverter produces an alternating voltage from a DC input voltage in response to control signals and the alternating voltage is increased by a voltage multiplier to generate the output voltage for biasing the X-ray tube.

The production of the output voltage is regulated by a feedback control circuit that includes a sensor which produces a sensor signal indicating the magnitude of the output voltage. A circuit determines a difference between the sensor signal and the voltage level reference signal and that difference is integrated to produce an integrated signal. Another source provides a duty cycle reference signal having a voltage level that corresponds to a one-hundred percent duty cycle of the inverter operation. A summation device arithmetically combines the integrated signal, the duty cycle reference signal and the sensor signal to form a DUTY CYCLE COMMAND signal.

An inverter driver generates the control signals for said inverter. The inverter driver is coupled to the integrator and to the summation device and the control signals have frequencies defined by the integrator signal and duty cycles defined by the DUTY CYCLE COMMAND signal. In the preferred embodiment, the inverter driver is a state machine that makes transitions from one operating state to another based on the truth of Boolean logic expressions of signal levels of the integrator signal and the DUTY CYCLE COMMAND signal. Each state corresponds to one of several combination of levels of the control signals for the inverter and the state machine in a given state produces controls signals having that combination of signal levels.

BRIEF DESCRIPTION OF THE DRAWINGS

FIG. 1 is a block diagram of a computed tomography imaging apparatus;

FIG. 2 is a block schematic diagram of the high voltage power supply within X-ray controller shown in FIG. 1;

FIG. 4 is a block diagram of one embodiment of the voltage-to-phase converters used in the inverter control circuit;

FIG. 5 is a state diagram of the operation of the converter in FIG. 4; and FIGS. 6A–6I, 7A–7I, 8A–8I and 9A–9I illustrate waveforms of signals at various points in the circuit of FIG. 4 during four different operating conditions.

DESCRIPTION OF THE PRESENT INVENTION

Figure 3:
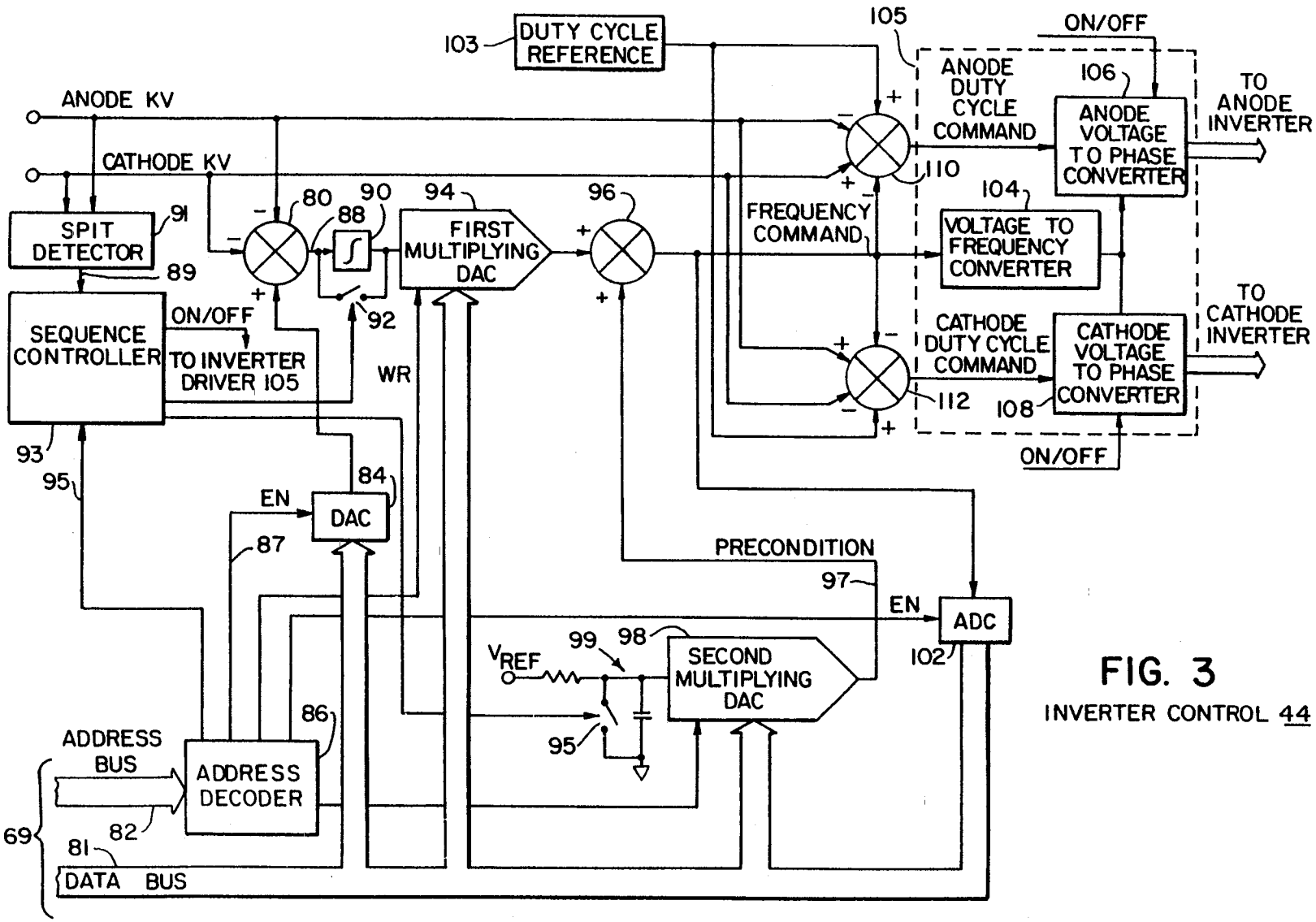
FIG. 3 is a schematic diagram of the inverter control in FIG. 2.
Figures 9A, 9B, 9C, 9D, 9E, 9F, 9G, 9H, 9I:
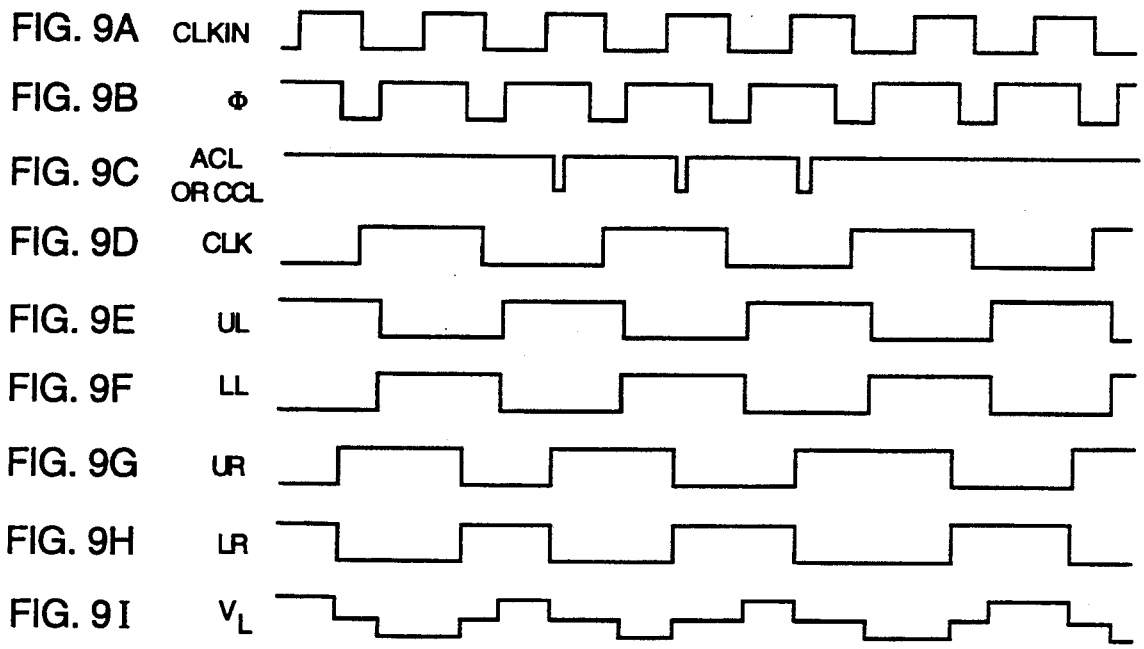

With initial reference to FIG. 1, a computed tomography (CT) imaging system 10 includes a gantry 12 having an X-ray source 13 that projects a fan beam of X-rays 14. The fan beam of X-rays 14 passes through a patient 15 being imaged and impinges upon an X-ray detector 16. The detector is an array of a plurality of detector elements 18, which together detect a projected image resulting from the transmission of X-rays through the patient 15. The gantry 12 and the components mounted thereon rotate about a center of rotation 19 to acquire a number of views of the patient.

A control mechanism of the CT system 10 has gantry associated control modules 21, which include an X-ray controller 22 that provides power to the X-ray source 13, a gantry motor controller 23 that controls the rotational speed and position of the gantry 12, and a data acquisition system (DAS) 24 that samples projection data from the detector elements 18 and converts the data into digital words for later computer processing.

The output of the DAS 24 is connected to an image processor 25 which receives sampled and digitized projection data from the DAS and performs high speed image reconstruction according to methods known in the art. The image reconstructor 25 may be an array processor. The reconstructed image is applied as an input to a computer 26 which stores the image in a mass storage device 29.

The X-ray controller 22 and gantry motor controller 23 are connected to receive control signals from the computer 26. The computer 26 produces the appropriate control signals in response to parameters for the scan which an X-ray technician enters via the keyboard of an operator console 30 that is connected to the computer. The reconstructed image and other performance information are displayed by the computer on an operator monitor 32. The mass storage device 29 also stores operating and calibration programs for the CT imaging system.

FIG. 2 depicts the components of the high voltage supply within the X-ray controller 22, which also contains conventional filament supply and emission current monitoring circuits (not shown). The control signals from the main computer 26 are carried by a set of signal buses 40 to an X-ray tube control computer 42 within the X-ray controller 22. At the outset of an exposure, these signals define the level of high voltage and current to be applied to the X-ray tube 13. The X-ray tube control computer 42 responds by sending commands to the inverter control 44 that cause the latter component to produce a set of control signals for an anode inverter 46 and a cathode inverter 48.

The two inverters 46 and 48 have identical construction with the details being shown for the anode inverter 46. The anode inverter 46 is a standard H bridge construction having four switches designated UL, UR, LL and LR. Four control signals from the inverter control 44 operate these four switches in a conventional fashion that switches DC voltage V+ in a manner that supplies an alternating voltage to voltage multiplier 50. Specifically, switches UL and LR are closed simultaneously to apply one polarity of voltage to the voltage multiplier 50 while the switches UR and LL of the inverter 46 are open. Then, switch LR opens and switch UR closes to cut off the application of voltage to voltage multiplier 50. Next, switch UL opens along with switch LR, and switches UR and LL are closed to apply the opposite polarity to the voltage multiplier 50. Thereafter, switch UR opens and switch LR closes to cut off voltage application to the voltage multiplier 50. Then the process repeats. This switching cycle of the four switches within the anode inverter 46 occurs in a rapid sequence to produce an alternating voltage which is applied through inductor 47 and capacitor 49 to the input of the voltage multiplier 50. The multiplier, inductor and capacitor form an RLC circuit load for the inverter 46, thus enabling the tube voltage to be controlled by the frequency at which the inverter switches operate as well as their duty cycle.

The frequency and duty cycle at which the switches UL, UR, LL and LR in each inverter 46 and 48 are operated determine the input voltage level applied to the pair of voltage multipliers 50 and 52. The voltage multipliers increase their input voltage by a fixed gain to produce an even higher voltage at their outputs. The negative output terminal of the anode voltage multiplier 50 is connected to the positive output terminal of the cathode voltage multiplier 52 at a node 53 connected to the ground for the imaging system. The positive output terminal 58 of the anode voltage multiplier 50 is connected to the anode of the X-ray tube 13 and the negative output terminal 59 of the cathode voltage multiplier 52 is connected to the cathode of the X-ray tube.

An anode current sensor 65 is coupled to an output line from anode inverter 46 to sense the level of the output current supplied to the anode voltage multiplier 50. A signal ACL is sent to the inverter control 44 when the sensed current exceeds a given level. A similar cathode current sensor 67 supplies a signal CCL to the inverter controller which indicates when the output current level from the cathode inverter 48 exceeds a predefined level. Both the ACL and CCL current limit signals are true when they have a low logic level.

Four resistors 54, 55, 56 and 57 are connected in series between the positive output terminal 58 of the anode voltage multiplier 50 and the negative output terminal 59 of the cathode voltage multiplier 52. The central node 60 of the series connection of the resistors 54–57 is connected to circuit ground. As a result of this connection, resistors 54 and 55 form a voltage divider across which is applied the output voltage from the anode voltage multiplier 50. The values of these resistors 54 and 55 are such that the voltage across resistor 55 is a relatively low voltage level which is proportional to the output of the anode voltage multiplier 50 and compatible with the digital control circuit in the X-ray controller 22. Similarly, resistors 56 and 57 form a voltage divider for the voltage from the cathode voltage multiplier 52. The values of these resistors are such that the voltage across resistor 56 is a compatible low voltage that is proportional to the output of the cathode voltage multiplier 52.

Anode voltage sensing lines 61 and 62 connect opposite ends of resistor 55 to the input of an anode voltage sensor circuit 66. Similarly, cathode voltage sensing lines 63 and 64 couple opposite ends of resistor 56 to the input of a cathode voltage sensor circuit 68. The anode voltage sensor circuit 66 produces a voltage level designated ANODE KV which corresponds to the anode voltage produced by voltage multiplier 50. Similarly, the cathode voltage sensor circuit 68 produces an output voltage level designated CATHODE KV which corresponds to the cathode voltage produced by voltage multiplier 52. Both of the signals, ANODE KV and CATHODE KV, are applied as inputs to the inverter control circuit 44. The inverter control circuit 44 compares the desired anode-cathode voltage for the X-ray exposure to the actual cathode and anode voltages represented by the ANODE KV and CATHODE KV signals. The operation of the inverter control circuit 44 regulates the operation of the inverters 46 and 48 to excite the X-ray tube to the desired anode-cathode high voltage.

FIG. 3 illustrates the details of the inverter control 44. The ANODE KV and CATHODE KV signals from the anode and cathode voltage sensor circuits 66 and 68 are applied to inverting inputs of a first summation circuit 80. A non-inverting input of summation circuit 80 receives a signal designated KV REFERENCE, which indicates the desired level of high voltage for the X-ray exposure.

The KV REFERENCE signal is produced by the X-ray technician entering the parameters of the desired X-ray exposure into the operator console 30 (FIG. 1). The main computer 26 receives the parameters, translates them into a command which is sent over signal buses 40 to the X-ray tube control computer 42. From this command, the latter computer 42 generates a digital value corresponding to the magnitude of the KV REFERENCE signal. The digital value is sent over a data bus 81 which is part of the internal buses 69 of the X-ray controller 22. At the same time, the X-ray tube control computer 42 applies an address to address bus 82, which is also part of buses 69, to access a first digital-to-analog converter (DAC) 84 within the inverter control 44. The address bus 82 is connected to an address decoder 86, which responds to the address of the first DAC 84 by producing an enable signal on line 87. The first DAC 84 responds to the enable signal by storing the digital value present on data bus 81. This digital value is converted into the analog KV REFERENCE signal which is applied by the first DAC 84 to the first summation circuit 80. The KV REFERENCE signal corresponds to the desired voltage potential across the anode and cathode of the X-ray tube 13 for the selected exposure.

The ANODE KV and CATHODE KV signals are subtracted from the KV REFERENCE signal to produce an error signal on line 88 at the output of the first summation circuit 80. The error signal on line 88 indicates the difference between the actual anode-cathode voltage potential and the desired level, as indicated by the KV REFERENCE signal. This error signal is applied to the input of a voltage integrator 90. The integrator 90 produces an output signal that adjusts the high voltage control loop to a level which makes the algebraic sum of ANODE KV, CATHODE KV and KV REFERENCE equal zero. An electrically operated switch 92 is connected in parallel with the integrator 90 and is operated by a control signal produced by the address decoder 86 in response to a specific address received from the X-ray tube control computer 42. The switch 92 is closed at the beginning of each exposure to reset the integrator to zero which action effectively opens the closed control loop. After a predefined delay, switch 92 opens to re-establish the closed control loop. The operation of the integrator reset switch 92 is controlled by a sequence controller 93 which receives an active control signal from the control computer 42 over line 95 to indicate the duration of the X-ray exposure. A spit detector 91 produces an output signal on line 89 to the sequence controller 89 whenever a high voltage breakdown, or spit, occurs in the X-ray tube 13. The signals received by the sequence controller are used in producing properly timed control signals for components of the inverter control 44, as will be identified subsequently.

The control signal produced by the integrator 90 is applied to the analog input of a multiplying digital-to-analog converter 94. The gain factor for the multiplying DAC 94 is received from the control computer 42 via the data bus 81 at the outset of the X-ray exposure and stored within DAC 94 in response to a write signal from address decoder 86. The gain factor normalizes the error signal to compensate for variations in the loop transfer function, which varies depending upon the specific parameters of the particular X-ray exposure.

The normalized control signal from the multiplying DAC 94 is applied to a non-inverting input of a second summation circuit 96. Another non-inverting input of the second summation circuit 96 receives a PRECONDITION signal on line 97. The PRECONDITION signal is an initial approximation of the expected closed loop operating level. The particular value of the PRECONDITION signal is selected for each high voltage level and expected load from the high voltage power supply. It is the prevailing command when the integrator reset switch 92 is closed during the first moments of the high voltage turn-on process at the beginning of an exposure. When the integrator reset switch 92 is open, the output of the integrator 90 as normalized by the multiplying DAC 94 is algebraically added to the PRECONDITION signal to bring the control loop into balance.

The PRECONDITION signal 97 is produced by the X-ray tube control computer 42 using an equation that is a function of the given set of parameters of the selected X-ray exposure. At the outset of an X-ray exposure, the computer 42 calculates a precondition factor which is transferred into a second multiplying DAC 98. The analog voltage reference input of the second multiplying DAC 98 is connected by a resistor-capacitor (RC) network 99 to a fixed voltage source $V_{REF}$. The RC network 99 applies an exponentially varying voltage to that input. A switch 95 is connected across the capacitor of the RC network 99 to reset the network between X-ray exposures and is operated by a signal from sequence controller 93.

The precondition data for each type of X-ray exposure is determined during the calibration phase of the CT system. At that time, the X-ray system is operated to produce the different X-ray exposures. During each exposure, the output of the second summation circuit 96 is sampled by enabling an analog-to-digital converter (ADC) 102. When enabled, the analog-to-digital converter 92 applies its digital output value to the X-ray tube control computer 42 via data bus 81. This sampling occurs at a point during the X-ray exposure at which the control loop has reached a quiescent state. The data from the analog-to-digital converter 102 are stored in the memory of the X-ray tube control computer 44. Once the data for all the different exposures have been acquired, an equation for the data as a function of the exposure parameters is derived using conventional curve fitting techniques. This equation is stored to determine the precondition factors for the second multiplying DAC 98.

The use of the PRECONDITION signal has significant benefit in enabling the control loop to stabilize relatively quickly as compared with previous feedback loop techniques. This is especially useful following a tube breakdown, or spit, in which case the proper tube excitation can recover very quickly as the initial condition of the feedback loop is established by the PRECONDITION signal which thereafter merely has to be adjusted slightly for minor variations.

The voltage level produced at the second summation circuit 96 defines the rate at which the switches UL, UR, LL and LR in inverters 46 and 48 are to be operated to produce the desired excitation voltage. This signal is applied to an inverter driver 105 and specifically to the input of a voltage-to-frequency converter 104, which generates an output signal having a frequency that corresponds to the switching rate. In this circumstance, a lower frequency signal produces a higher output voltage from the inverter/voltage multiplier combinations shown in FIG. 2. This frequency signal produced by the converter 104 is applied to an anode voltage-to-phase converter 106 and a cathode voltage-to-phase converter 108.

The output of the second summation circuit 96 also is applied to an inverting input of a third summation circuit 110 that receives the ANODE KV and CATHODE KV signals at inverting and non-inverting inputs, respectively. A source 103 supplies reference voltage to a non-inverting input of the third summation circuit 110 which voltage corresponds to a one-hundred percent duty cycle of the inverters 46 and 48. The third summation circuit 110 algebraically adds the input signals to produce an output voltage that represents the desired anode inverter average duty cycle which has been adjusted to balance the anode and cathode voltages produced by voltage multipliers 50 and 52. This output voltage from the third summation circuit 110 is applied as an ANODE DUTY CYCLE COMMAND to the anode voltage-to-phase converter 106 in the inverter driver 105. This converter 106 responds to the duty cycle command and the frequency signal from converter 104 by producing a set of output signals which operate the four switches within the anode inverter 46 shown in FIG. 2. The operation of the inverter switches UL, UR, LL and LR produces an alternating voltage signal which is applied to the input of the anode voltage multiplier 50 to generate the proper level of a high voltage which is applied between ground and the anode of the X-ray tube 13.

Similarly, a fourth summation circuit 112 receives the output from the second summation circuit 96, the ANODE KV and CATHODE KV signals, and a 100 percent duty cycle reference voltage. It is noted that the polarity of the inputs of the fourth summation circuit 112 that receive the ANODE KV and CATHODE KV signals are reversed from the polarity of the inputs for these signals at the third summation circuit 110 so as to produce the proper CATHODE DUTY CYCLE COMMAND. The output of the fourth summation circuit 112 is applied as the duty cycle command to the cathode voltage-to-phase converter 108 which generates a set of control signals to operate the switches within the cathode inverter 48.

FIG. 4 illustrates an embodiment of each voltage-to-phase converters 106 and 108. For this embodiment, the voltage-to-frequency converter 104 has a square wave generator 120 which produces a square wave output signal designated CLKIN that has a frequency corresponding to the level of the voltage of the FREQUENCY COMMAND received from the second summation circuit 96. The voltage-to-frequency converter 104 also has a triangle wave generator 122 that produces a triangular shaped waveform which also has the frequency dictated by the FREQUENCY COMMAND. The triangular shaped waveform is applied to the non-inverting input of a comparator 124 which receives the DUTY CYCLE COMMAND at its inverting input. As a result, the comparator 124 produces a square wave output signal designated Φ which has a duty cycle corresponding to the level of the duty cycle command voltage.

The Φ and CLKIN signals are applied to digital inputs of an asynchronous finite state machine 126. The state machine 126 divides the CLKIN signal by two to produce an interval timing signal CLK. Another digital input of the state machine 126 receives the current limit signal ACL or CCL generated by anode or cathode current sensors 65 or 67 (FIG. 2) when a current limit for the X-ray exposure has been reached. The state machine 126 is activated by the ON/OFF signal from the sequence controller 93 and when off the state machine opens all the inverter switches.

The state machine 126 consists of a combinatorial logic block which accepts control signals and state variables as inputs, and produces state variables (switch control signals) as outputs. The state machine may be implemented using a model 22V10 programmable logic array made by Advanced Micro Devices, Inc. The eight valid states 131–138 in which the state machine operates are shown in FIG. 5. The arrows designate each permitted transition from one state to another and the Boolean logic expressions of the input signals CLK, Φ, and a current limit signal CL (either ACL or CCL) determine when the associated state transition occurs. If an expression is not provided for a given state transition (i.e. between states 132 and 133), then that transition occurs automatically once the output levels for the switches have been set in the previous state. The four binary bits within each state represent the level of the control signals UL, LL, UR and LR (reading from left to right) and thus the conductivity state of the corresponding switch within the inverter 46 or 48. The inverter switches are conductive while the associated switch control signal is at a high, or a one, logic level and non-conductive while the associated control signal has a low, or zero, logic level. States 131, 133, 135 and 137 are the primary states at which the inverters 46 and 48 are off, positive voltage on, off and negative voltage on, respectively. Two switch control signal levels change from one primary state to the next and the order in which the switch control signals change is important. To insure the proper sequence intermediate states 132, 134, 136 and 138 are used. A Boolean logic expression of the input signals must be true for a transition from one of the primary states to occur, but the transition from the associated intermediate state to the next primary state occurs automatically once the state machine has set the switch control signal levels at the intermediate state.

The waveforms of the input signals to the state machine 126 and the corresponding switch control signals waveforms for controlling the inverter switches are shown in FIGS. 6A–6I for normal operation of the X-ray controller 22. The relative phase relationship of the switch control signals will vary in this mode depending upon the requisite high voltage level to be produced. In normal operations, the voltage supplied to the voltage multiplier is regulated by control of the switching frequency through CLKIN, and the duty cycle through Φ. When Φ goes to a low logic level, the inverter bridge switches from on to off states and remains off until Φ again goes to a high logic level. The voltage at the output of the inverted is designated $V_L$. FIGS. 7A–7I show the control circuit operation when the anode to cathode voltage is below the level desired for the exposure. Note that Φ never goes to a low logic level in this case and the switches change states based on transitions of the CLK signal. In this case, the operation of the switches for the inverters 46 and 48 are perfectly in phase to apply maximum voltage to input the corresponding voltage multiplier 50 or 52. FIGS. 8A–8I illustrate the signal waveforms for the case where the anode-cathode voltage is above the level desired for the X-ray exposure. In this case, the signal Φ is at a constant low logic level which results in the switches forced to remain in an off state. With the inverter off the voltage level eventually will fall to an acceptable level and the switches will begin normal cycling again.

FIGS. 9A–9I illustrate the condition when the current sensor 65 or 67 issues a true current limit signal, ACL, as occurs during recovery from a sudden overload, such as a tube spit. The current limit signals are true at low logic levels as occur during the three downward pulses in the waveform. The operation begins in a manner similar to the normal operation shown in FIGS. 6A–6I. However the ACL signal going low causes the switches to transition from an on state to an off state sooner than the Φ signal commands. Thereafter, the switches remain off until the next normal turn on time.

The generation of the inverter control signals in this manner allows full range of control from full on to full off. Previous controllers for the inverters required delicate duty cycle calibration to prevent loss of control at operating points near full on and full off. Such calibration is not required for the present invention.

The invention being claimed is:

1. A high voltage power supply for biasing an X-ray tube comprising:

a first source of a reference voltage level that represents a desired bias voltage magnitude for the X-ray tube;

an inverter that produces an alternating voltage from a DC input voltage in response to control signals;

a voltage multiplier connected to said inverter to increase the alternating voltage thereby producing an output voltage of the power supply;

a voltage sensor for sensing the output voltage and producing a sensor signal indicating a magnitude of the output voltage;

a circuit coupled to said first source and said voltage sensor, and determining a difference between the sensor signal and the voltage level reference signal;

an integrator connected to said circuit to integrate the difference between the output voltage and the voltage level reference signal to produce an integrated signal;

a second source of a duty cycle reference signal;

a summation device coupled to said integrator, said second source and said voltage sensor for combining the integrated signal, the duty cycle reference signal and the sensor signal to produce a DUTY CYCLE COMMAND signal; and an inverter driver coupled to said integrator and said summation device for generating control signals for said inverter wherein the control signals have frequencies defined by the integrator signal and have duty cycles defined by the DUTY CYCLE COMMAND signal.

2. The high voltage power supply as recited in claim 1 further comprising:

another summation device for combining a precondition signal with the integrated signal to produce a resultant signal that is applied to said second summation device and said inverter driver in place of the integrated signal; and a third source of a precondition signal which is an approximation of a nominal value of the resultant signal and which is connected to said another summation device.

3. The high voltage power supply as recited in claim 2 further comprising a mechanism for sampling the resultant signal to define the precondition signal.

4. The high voltage power supply as recited in claim 1 wherein said inverter driver comprises:

a voltage to frequency converter that produces a first signal and a triangular wave signal having common frequencies that are controlled by the integrator signal;

a differential amplifier having inputs coupled to the triangular wave signal and the DUTY CYCLE COMMAND signal, and producing a signal designated Φ which has first and second logic levels; and a signal generator that produces the control signals in response to signals from said voltage to frequency converter and said differential amplifier.

5. The high voltage power supply as recited in claim 4 wherein said signal generator comprises a state machine having a plurality of states each of which corresponding to one of several combination of levels of the control signals for the inverter.

6. The high voltage power supply as recited in claim 4 wherein said signal generator produces a signal CLK by dividing the first signal by two, and comprises state machine having:

a) a first state in which the control signals are produced which cause said inverter to apply a one voltage polarity to said voltage multiplier;

b) a second state in which the control signals are produced which cause said inverter not to apply voltage to said voltage multiplier, wherein a transition occurs from the first state to the second state in response to the CLK signal having the third logic level or to the Φ signal having the second logic level;

c) a third state in which the control signals are produced which cause said inverter to apply an opposite voltage polarity to said voltage multiplier, wherein a transition occurs from the second state to the third state in response to the CLK signal having the third logic level and the Φ signal having the first logic level; and d) a fourth state in which the control signals are produced which cause said inverter to not apply voltage to said voltage multiplier, wherein a transition occurs from the third state to the fourth state in response to the CLK signal having the fourth logic level or to the Φ signal having the second logic level, and wherein a transition occurs from the fourth state to the first state in response to the CLK signal having the fourth logic level and the Φ signal having the first logic level.

7. The high voltage power supply as recited in claim 4 further comprising a current sensor that provides a signal designated CL which has a true logic when an output current of said inverter exceeds a given level and has a false logic level at other times.

8. The high voltage power supply as recited in claim 7 wherein said signal generator produces a signal CLK by dividing the first signal by two, and comprises state machine having:

a) a first state in which the control signals are produced which cause said inverter to apply a one voltage polarity to said voltage multiplier;

b) a second state in which the control signals are produced which cause said inverter not to apply voltage to said voltage multiplier, wherein a transition occurs from the first state to the second state in response to the CLK signal having the third logic level or to the Φ signal having the second logic level or to the CL signal having a true logic level;

c) a third state in which the control signals are produced which cause said inverter to apply an opposite voltage polarity to said voltage multiplier, wherein a transition occurs from the second state to the third state in response to the CLK signal having the third logic level and the Φ signal having the first logic level and the CL signal having a false logic level; and d) a fourth state in which the control signals are produced which cause said inverter to not apply voltage to said voltage multiplier, wherein a transition occurs from the third state to the fourth state in response to the CLK signal having the fourth logic level or to the Φ signal having the second logic level or to the CL signal having a true logic level, and wherein a transition occurs from the fourth state to the first state in response to the CLK signal having the fourth logic level and the Φ signal having the first logic level and the CL signal having a false logic level.

9. A high voltage power supply for biasing an anode and a cathode of an X-ray tube a first source of a reference voltage level that represents a desired bias voltage magnitude for the X-ray tube;

an anode inverter that produces an alternating anode bias voltage from a DC input voltage in response to anode inverter control signals;

an anode voltage multiplier connected to said anode inverter to increase the alternating voltage thereby producing an anode output voltage;

an anode voltage sensor for sensing the anode output voltage and producing a first sensor signal indicating a magnitude of the anode output voltage;

an cathode inverter that produces an alternating cathode bias voltage from a DC input voltage in response to cathode inverter control signals;

an cathode voltage multiplier connected to said cathode inverter to increase the alternating voltage thereby producing an cathode output voltage;

an cathode voltage sensor for sensing the cathode output voltage and producing a second sensor signal indicating a magnitude of the cathode output voltage;

a circuit coupled to said first source and to said anode and cathode voltage sensors, and producing a difference signal indicating a degree of difference between combination of the first and second sensor signals and the voltage level reference signal;

an integrator connected to said circuit to integrate the difference signal to produce an integrated signal;

a second source of a duty cycle reference signal;

a first summation device coupled to said integrator, said second source and said anode and cathode voltage sensors for combining the integrated signal, the duty cycle reference signal and the first and second sensor signals to produce an ANODE DUTY CYCLE COMMAND signal;

a second summation device coupled to said integrator, said second source and said anode and cathode voltage sensors for combining the integrated signal, the duty cycle reference signal and the first and second sensor signals to produce an CATHODE DUTY CYCLE COMMAND signal; and an inverter driver coupled to said integrator and said first and second summation devices for generating the cathode inverter control signals having frequencies defined by the integrator signal and duty cycles defined by the CATHODE DUTY CYCLE COMMAND signal, and generating the anode inverter control signals having frequencies defined by the integrator signal and duty cycles defined by the ANODE DUTY CYCLE COMMAND signal.

10. The high voltage power supply as recited in claim 9 further comprising another summation device for combining a precondition signal with the integrated signal to produce a resultant signal that is applied to said first and second summation devices and said inverter driver in place of the integrated signal; and a third source of a precondition signal which is an approximation of a nominal value of the resultant signal and which is connected to said another summation device.

11. The high voltage power supply as recited in claim 10 further comprising a mechanism for sampling the integrated signal to define the precondition signal.

12. The high voltage power supply as recited in claim 9 wherein each one of said anode and cathode inverters has four switches connected in an H bridge and controlled by control signals from said inverter driver.

13. The high voltage power supply as recited in claim 12 further comprising:

an anode current sensor that provides a true current limit signal to said anode inverter control circuit when said anode inverter produces an output current that exceeds a given level; and a cathode current sensor that provides another true current limit signal to said cathode inverter control circuit when said cathode inverter produces an output current that exceeds a predefined level.

14. The high voltage power supply as recited in claim 13 wherein said inverter driver includes:

signal generator that produces a first signal and a triangular wave signal having common frequencies that are controlled by the integrator signal;

an anode inverter control circuit to generate control signals for operating the switches of said anode inverter; and an cathode inverter control circuit to generate control signals for operating the switches of said cathode inverter.

15. The high voltage power supply as recited in claim 14 wherein each one of said anode and cathode inverter control circuits comprises:

a differential amplifier having one input coupled to the triangular wave signal, another input coupled to one of the ANODE DUTY CYCLE COMMAND signal and the CATHODE DUTY CYCLE COMMAND signal, and producing a signal designated Φ which has first and second logic levels; and a state machine that derives a signal CLK, which has third and fourth logic levels, by dividing the first signal by two, and said state machine having:

a) a first state in which the control signals are produced which cause said inverter to apply a one voltage polarity to said voltage multiplier;

b) a second state in which the control signals are produced which cause said inverter not to apply voltage to said voltage multiplier, wherein a transition occurs from the first state to the second state in response to the CLK signal having the third logic level or to the Φ signal having the second logic level or to the ACL signal or a true current limit signal;

c) a third state in which the control signals are produced which cause said inverter to apply an opposite voltage polarity to said voltage multiplier, wherein a transition occurs from the second state to the third state in response to the CLK signal having the third logic level and the Φ signal having the first logic level and a false current limit signal; and d) a fourth state in which the control signals are produced which cause said inverter to not apply voltage to said voltage multiplier, wherein a transition occurs from the third state to the fourth state in response to the CLK signal having the fourth logic level or to the Φ signal having the second logic level or to a true current limit signal, and wherein a transition occurs from the fourth state to the first state in response to the CLK signal having the fourth logic level and the Φ signal having the first logic level and a false current limit signal.

* * * * *